US008006768B2

(12) United States Patent
Powell et al.

(10) Patent No.: US 8,006,768 B2
(45) Date of Patent: Aug. 30, 2011

(54) SYSTEM AND METHOD FOR CONTROLLING A DOWNHOLE ACTUATOR

(75) Inventors: Reinhard Powell, Pearland, TX (US); Laure Mandrou, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 180 days.

(21) Appl. No.: 12/192,203

(22) Filed: Aug. 15, 2008

(65) Prior Publication Data

US 2010/0038092 A1 Feb. 18, 2010

(51) Int. Cl.
*E21B 34/10* (2006.01)

(52) U.S. Cl. ..... 166/375; 166/320; 166/386

(58) Field of Classification Search ..... 166/316, 166/319, 336, 321, 325, 332.1, 386, 375
See application file for complete search history.

(56) References Cited

U.S. PATENT DOCUMENTS

| | | | | |
|---|---|---|---|---|
| 3,414,059 | A | 12/1968 | Nutter | |
| 6,173,772 | B1 | 1/2001 | Vaynshteyn | |
| 6,276,458 | B1 | 8/2001 | Malone | |
| 6,321,842 | B1 | 11/2001 | Pringle | |
| 6,433,991 | B1 | 8/2002 | Deaton | |
| 6,502,640 | B2 | 1/2003 | Rayssiguier | |
| 6,505,684 | B2 | 1/2003 | Rayssiguier | |
| 6,523,613 | B2 | 2/2003 | Rayssiguier | |
| 6,536,530 | B2 | 3/2003 | Schultz | |
| 6,585,051 | B2 * | 7/2003 | Purkis et al. | 166/374 |
| 6,668,935 | B1 | 12/2003 | McLoughlin | |
| 6,782,952 | B2 * | 8/2004 | Garay et al. | 166/374 |
| 6,892,816 | B2 | 5/2005 | Pringle | |
| 6,966,380 | B2 | 11/2005 | McLoughlin | |
| 6,973,974 | B2 | 12/2005 | McLoughlin | |
| 7,013,980 | B2 * | 3/2006 | Purkis et al. | 166/386 |
| 2005/0034875 | A1 | 2/2005 | McLoughlin | |
| 2005/0279496 | A1 | 12/2005 | Fontenot | |
| 2006/0254763 | A1 | 11/2006 | Tips | |

FOREIGN PATENT DOCUMENTS

| | | |
|---|---|---|
| GB | 2376055 | 12/2002 |
| GB | 2389405 | 12/2003 |
| GB | 2389406 | 12/2003 |
| GB | 2396200 | 6/2004 |
| WO | 0121935 | 3/2001 |
| WO | 0149969 | 7/2001 |

* cited by examiner

*Primary Examiner* — Thomas A Beach
*Assistant Examiner* — James G Sayre
(74) *Attorney, Agent, or Firm* — Brandon S. Clark; Rodney Warfford

(57) ABSTRACT

A technique is provided for utilizing a hydraulic fluid metering control module in cooperation with a downhole component. The downhole component is shifted via hydraulic fluid delivered through first and/or second control lines to an actuator of the downhole component. The hydraulic fluid metering control module works in cooperation with the actuator and the control lines to enable shifting of the actuator according to a controlled, incremental process.

17 Claims, 5 Drawing Sheets

SYSTEM AND METHOD FOR CONTROLLING A DOWNHOLE ACTUATOR

BACKGROUND

In a variety of well applications, actuators are used to control downhole components, such as downhole flow control valves. An actuator is selectively shifted to transition the corresponding downhole component between operational configurations. For example, an actuator can be used to shift a flow control valve between open and closed positions.

Control over the actuator is exercised according to a variety of techniques. In some applications, the actuator is a hydraulically motivated actuator that responds to application of pressurized hydraulic fluid. For example, pressurized hydraulic fluid can be applied through a control line to move the actuator in a desired direction. Hydraulic metering systems can be employed to meter hydraulic fluid delivered to the actuator based on pressure increases and/or decreases applied to one or more control lines.

SUMMARY

In general, the present invention provides a system and method for utilizing a hydraulic fluid metering control module in cooperation with a downhole component, such as a flow control valve. The downhole component can be shifted via hydraulic fluid delivered through first and second control lines to an actuator of the downhole component. The hydraulic fluid metering control module works in cooperation with the actuator and the control lines to enable shifting of the actuator according to a controlled, incremental process.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for controlling the activation of a downhole component. The downhole component may be part of well completion equipment and may comprise, for example, a flow control valve. A hydraulic fluid metering control system is used to incrementally move an actuator of the downhole component. In a flow control valve, for example, the hydraulic fluid metering control module may be used to incrementally displace an actuator coupled to an annular choke which controls the production or injection flow rates of reservoir fluids.

In one embodiment, the control module is used to meter hydraulic fluid displaced from an actuator through a hydraulic control line in a manner that controls the incremental displacement of the actuator. In a flow valve application, displacement of the actuator increases or decreases the injection or production flow rate of reservoir fluids into or out of the reservoir. The hydraulic fluid metering control module is controlled using two hydraulic control lines. For each pressure cycle input through a first hydraulic control line, a predetermined volume of fluid is metered from the actuator. Each pressure cycle increments the actuator position a predetermined distance. This process can be repeated until the actuator is moved in a first direction to a fully open and/or fully closed position. A second hydraulic control line is used to displace the actuator to its maximum displacement in a second direction, e.g. to a fully closed position, from any intermediate position.

Figure 1:
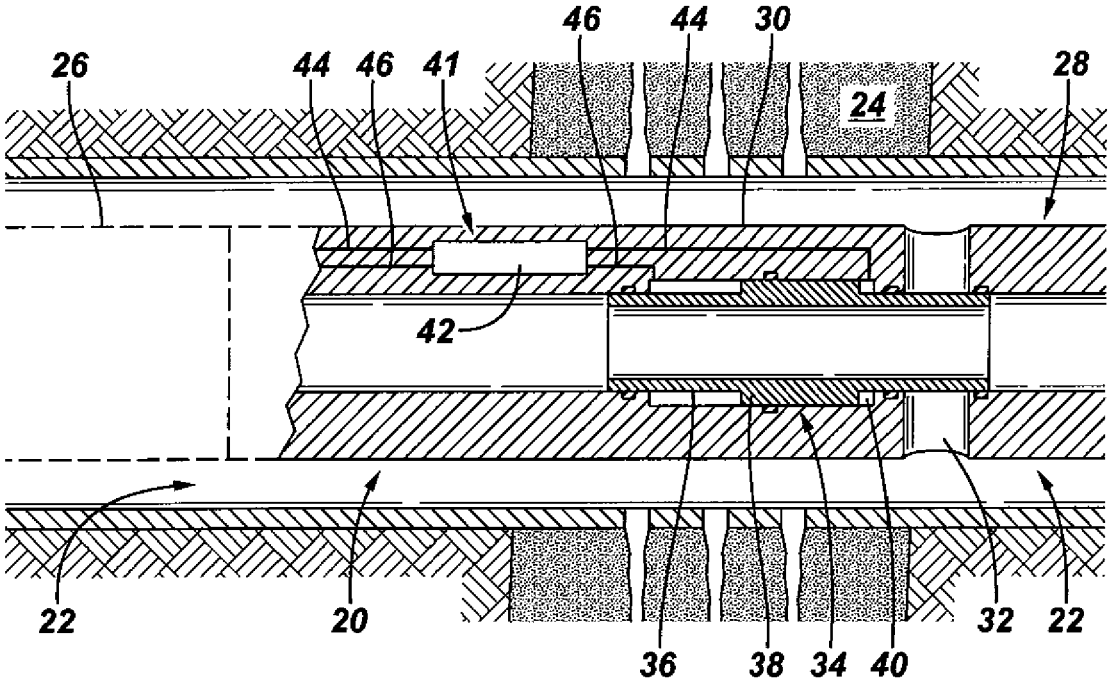
FIG. 1 is a schematic illustration of a shiftable downhole component and a fluid metering control system deployed in a wellbore, according to an embodiment of the present invention.

Referring generally to FIG. 1, a well system 20 is deployed in a wellbore 22 according to one embodiment of the present invention. The wellbore 22 is illustrated as extending into or through a reservoir 24, such as a hydrocarbon bearing reservoir. Well system 20 comprises a well string 26, such as a completion equipment string, having a shiftable well component 28. By way of example, well component 28 may comprise a flow valve 30 having a flow passage 32 through which fluid passes from well string 26 into the surrounding reservoir 24 or from reservoir 24 into well string 26. Movement of fluid through flow passage 32 is controlled by a valve element 34, such as a choke or sliding sleeve. The valve element 34 is connected to an actuator 36, which may be in the form of a piston 38 that can be moved along a sealed piston cavity 40. It should be noted that actuator 36 can be connected to a variety of other downhole components that are actuated between different configurations.

The movement of actuator 36 is controlled by a fluid metering control system 41 that may comprise a hydraulic fluid metering control module 42 designed to control the movement of actuator 36 in predetermined increments. For example, control module 42 can be used to control the flow of hydraulic fluid into and out of piston cavity 40. The flow of hydraulic fluid into and out of piston cavity 40 forces actuator 36 to move in one direction or the other which, in turn, moves valve element 34 and transitions well component 28 between open and closed configurations. If well component 28 comprises a flow valve, control module 42 enables controlled movement of actuator 36 and valve element 34 by predetermined increments to control the amount of flow through flow passage 32.

As illustrated, a first hydraulic control line 44 and a second hydraulic control line 46 are connected to hydraulic fluid metering control module 42. The hydraulic control lines 44, 46 are further coupled between control module 42 and actuator 36. For example, a portion of first hydraulic control line 44 may be routed from control module 42 to piston cavity 40 on a first side of piston 38. A portion of the second hydraulic control line 46 may be routed from control module 42 to piston cavity 40 on a second side of piston 38, as illustrated. Thus, fluid flow into piston cavity 40 through first hydraulic control line 44 and out of piston cavity 40 through second hydraulic control line 46 moves actuator 36 in a first direction. Similarly, fluid flow into piston cavity 40 through second hydraulic control line 46 and out of piston cavity 40 through first control line 44 moves actuator 36 in an opposite direction. Control module 42 limits the movement of actuator 36 to specific, predetermined increments in one or both directions.

Figure 2:
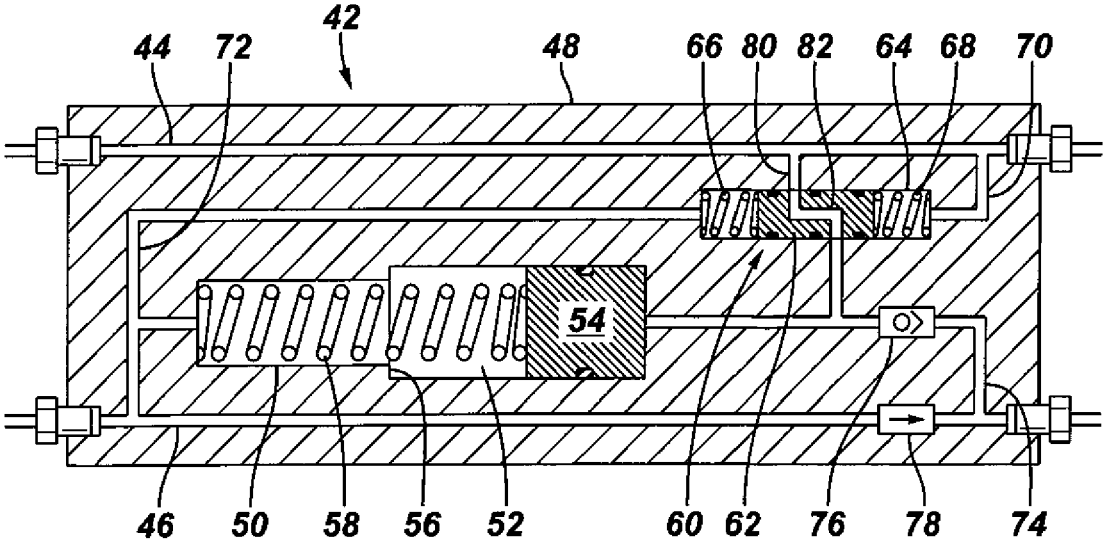
FIG. 2 is a schematic illustration of one example of a hydraulic fluid metering control module that can be used in the system illustrated in FIG. 1, according to an embodiment of the present invention.

One embodiment of hydraulic fluid metering control module 42 is illustrated in FIG. 2. In this embodiment, control module 42 comprises a housing 48, and hydraulic control lines 44, 46 extend through the housing 48. Within housing 48, a spring chamber 50 is in open communication with a piston chamber 52. A metering piston 54 is slidably sealed within piston chamber 52 for movement between an original position, as illustrated, and a metering position in which movement of piston 54 is limited by a stop 56. A spring 58 is positioned in the spring chamber 50 and acts against metering piston 54 to bias the metering piston toward the original position.

In the embodiment illustrated, a piloted valve 60 also is located within housing 48. Piloted valve 60 works in cooperation with metering piston 54 to limit movement of actuator 36 to specific increments, as explained in greater detail below. The piloted valve 60 may be constructed in a variety of configurations. In the embodiment illustrated, for example, piloted valve 60 is a dual piloted, normally open valve having a piston 62 slidably sealed within a pilot valve piston chamber 64. The piston 62 is biased to a normally open position by springs 66 and 68 which are located in piston chamber 64 on opposite ends of piston 62.

Control line 44 is connected to piston chamber 64 on one side of pilot piston 62 by a branch passage 70. Similarly, control line 46 is connected to piston chamber 64 on an opposite side of pilot piston 62 by a branch passage 72. Branch passage 72 also is connected with spring chamber 50 and thus piston chamber 52 on the spring side of metering piston 54. Furthermore, control line 46 is connected to piston chamber 52 on an opposite side of metering piston 54 by a branch passage 74 which includes a check valve 76 oriented to prevent flow from piston chamber 52 to hydraulic control line 46. The hydraulic control module 42 also comprises a pressure relief valve 78 located in control line 46 between the junction of branch passage 72 with control line 46 and the junction of branch passage 74 with control line 46. When piloted valve 60 is in its normally open position, as illustrated, first control line 44 also is connected with branch passage 74, between piston chamber 52 and check valve 76, by a crossover branch 80. Pilot piston 62 has a lateral passage 82 that allows fluid flow along crossover branch 80 when piloted valve 60 is in the illustrated, open configuration.

The piloted valve 60 is normally open and allows hydraulic fluid communication along crossover branch 80, however hydraulic pressure applied to either control line 44 or control line 46 shifts piston 62 and stops fluid communication along crossover branch 80. Pilot valve springs 66, 68 are positioned to move piston 62 and bias piloted valve 60 to its normally open position. It should also be noted that pressure relief valve 78 allows fluid communication along control line 46 upon reaching a certain predetermined pressure, as explained in greater detail below.

In operation, control module 42 is used to control the flow of specific volumes of fluid out of and into actuator piston cavity 40 to precisely control the incremental movement of the actuator 36. With further reference to FIG. 1, displacement of actuator 36 one increment to the left (the valve opening direction) is initiated by applying a hydraulic pressure signal in control line 44. As the hydraulic pressure is increased in control line 44 to a predetermined pressure, the pressure also increases in branch passage 70. The pressure in branch passage 70 moves pilot piston 62 which closes piloted valve 60 such that fluid can no longer be communicated along crossover branch 80.

As the pressure is further increased in first control line 44, the seal friction of actuator 36 is overcome and actuator 36 begins to move to the left. The hydraulic fluid in the portion of piston cavity 40 on the left/opposite side of piston 38 is forced into second control line 46 and into control module 42. Within control module 42, the discharged hydraulic fluid can only pass through check valve 76 and into piston chamber 52. As fluid flows into piston chamber 52, metering piston 54 is displaced until reaching hard stop 56. The volume of hydraulic fluid allowed to displace metering piston 54 controls the distance over which actuator 36 is incremented.

Subsequently, hydraulic pressure on control line 44 is bled, however metering piston 54 stays displaced to the left against stop 56 until piloted valve 60 is once again biased to the normally open position. At this point, spring 58 moves metering piston 54 back to its original position and exhausts the hydraulic fluid accumulated in piston chamber 52 through crossover branch 80 and back into control line 44. Additional pressure increases and decreases on control line 44 can be used to further increment actuator 36 until it reaches, for example, its fully displaced position, e.g. a fully open position.

The actuator 36 can be moved in an opposite direction to a fully closed position, for example, by applying sufficient hydraulic pressure through second control line 46. The application of hydraulic pressure in control line 46 again closes piloted valve 60 via pressure applied through branch passage 72. While the piloted valve 60 is closed, hydraulic pressure/fluid cannot be communicated from control line 46 to control line 44 and the opening side of actuator 36. The pressure relief valve 78 is designed to open at a pressure above the pressure at which piloted valve 60 is shifted to a closed position. The continued flow of fluid through control line 46 then enters piston cavity 40 on a closing side of piston 38 to forced actuator 36 to the right in the embodiment illustrated in FIG. 1.

The design of hydraulic fluid metering control module 42 also enables the mechanical shifting of actuator 36. If there is no hydraulic pressure on either control line 44 or control line 46, the actuator 36 can be mechanically shifted. For example, if actuator 36 is mechanically shifted to the left in an opening direction, hydraulic fluid is forced by piston 38 into control module 42, through branch passage 74 and crossover branch 80 until being exhausted into control line 44. When the actuator 36 is mechanically shifted to the right in a closing direction, hydraulic fluid is forced by piston 38 directly into control line 44. Hydraulic fluid is supplied to piston chamber 40 on an opposite side of piston 38 through control line 46 and pressure relief valve 78.

Figure 3:
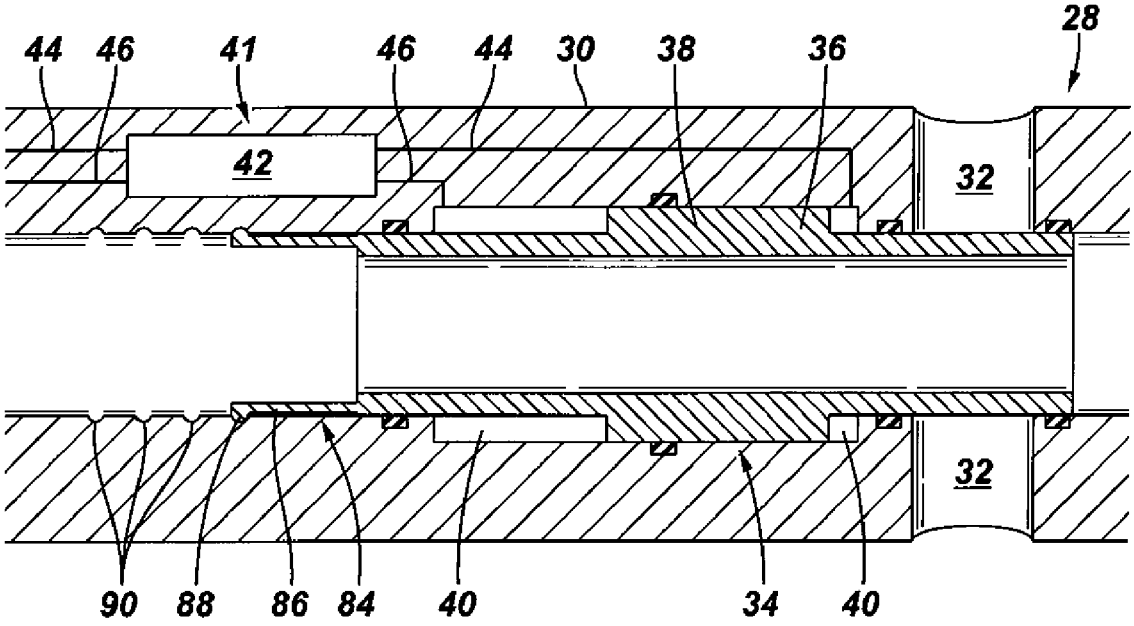
FIG. 3 is a schematic illustration of another example of a shiftable downhole component and a fluid metering control system deployed in a wellbore, according to an alternate embodiment of the present invention.

Referring generally to FIG. 3, another embodiment of shiftable well component 28 is illustrated. In this embodiment, a mechanical retention or locking mechanism 84 is used to resist movement of actuator 36. By way of example, mechanism 84 may comprise a collet 86 having retention features 88 designed to engage corresponding retention features 90 formed within housing 48. The use of retention mechanism 84 enables, for example, elimination of the check valve 76 from the control module 42.

Figure 4:
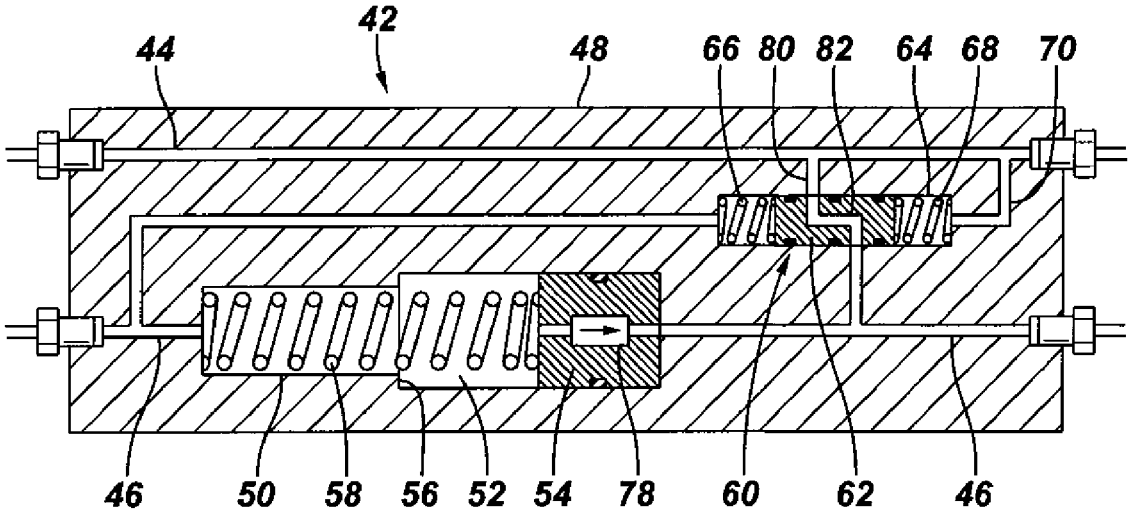
FIG. 4 is a schematic illustration of one example of a hydraulic fluid metering control module that can be used in the system illustrated in FIG. 3, according to an embodiment of the present invention.

In FIG. 4, one example of a control module 42 that can be used in cooperation with retention mechanism 84 is illustrated. In this embodiment, the actuator of FIG. 3 can be moved to the left by increments through the application of a pressure signal in control line 44, as described above with respect to the embodiment of FIGS. 1 and 2. Following incremental movement of the actuator 36, however, the retention mechanism 84, e.g. collet 86, prevents movement of actuator 36. Because actuator 36 does not move, transmission of the metered volume of fluid from piston chamber 52 back to piston cavity 40 through control line 46 is prevented when hydraulic pressure is bled from control line 44. Spring 58 does not provide enough force to overcome the locking force of retention features 88 combined with the seal friction force of actuator 36. As a result, the metered hydraulic fluid in piston chamber 52 can only be exhausted to control line 44 after the dual piloted, normally open valve 60 reopens.

Using retention mechanism 84 to prevent the back flow of fluid from piston chamber 52 to piston cavity 40 eliminates the need for check valve 76 in the embodiment of FIG. 2. However, other changes also can be made to the configuration of control module 42. For example, control line 46 can be directed through metering piston 54, and pressure relief valve 78 can be relocated to an interior of metering piston 54. However, control module 42 can be arranged in a variety of other configurations depending on the specific application of well system 20.

Figure 5:
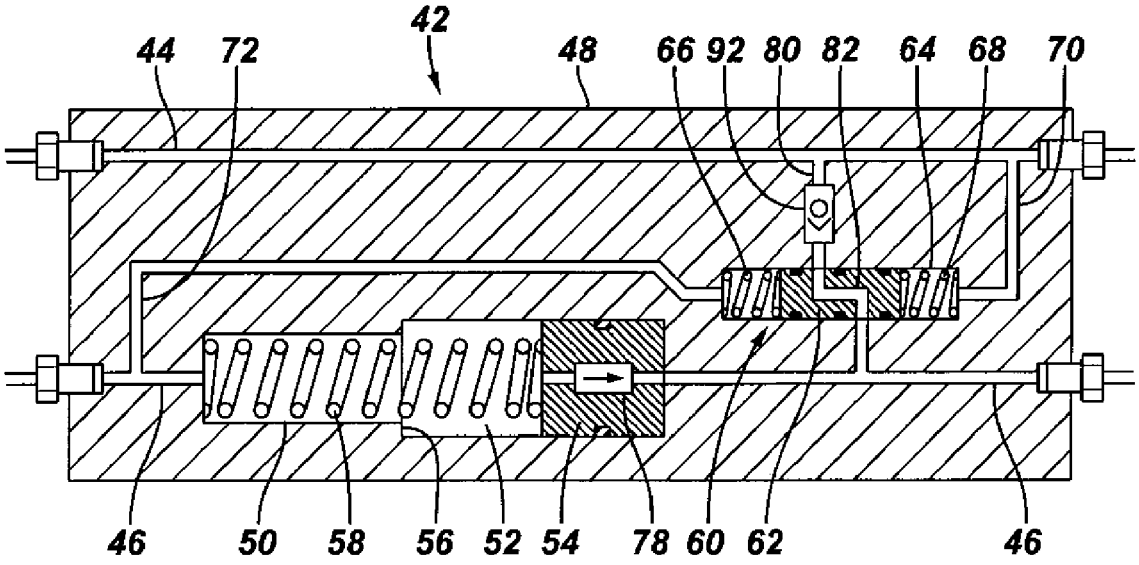
FIG. 5 is a schematic illustration of another example of a hydraulic fluid metering control module that can be used in the system illustrated in FIG. 3, according to an alternate embodiment of the present invention.

As illustrated in FIG. 5, for example, another embodiment of control module 42 is illustrated for use with actuator 36 and retention mechanism 84. In this embodiment, the arrangement of components in control module 42 is similar to that described with reference to FIG. 4. However, a check valve 92 is added in crossover branch 80 between control line 44 and the lateral passage 82 extending through piston 62 of piloted valve 60. Check valve 92 is used to prevent hydraulic pressure from being transmitted through crossover 80 to control line 46 when pressure is applied to control line 44. If hydraulic pressure is transmitted through crossover 80 before the piloted valve 60 closes, the metering piston 54 can be displaced prematurely, resulting in inaccurate metering. Alternatively, however, the piloted valve 60 can be designed to close at a lower pressure than the pressure required to overcome the seal friction of actuator 36 and the spring force of spring 58 acting against metering piston 54.

Figure 6:
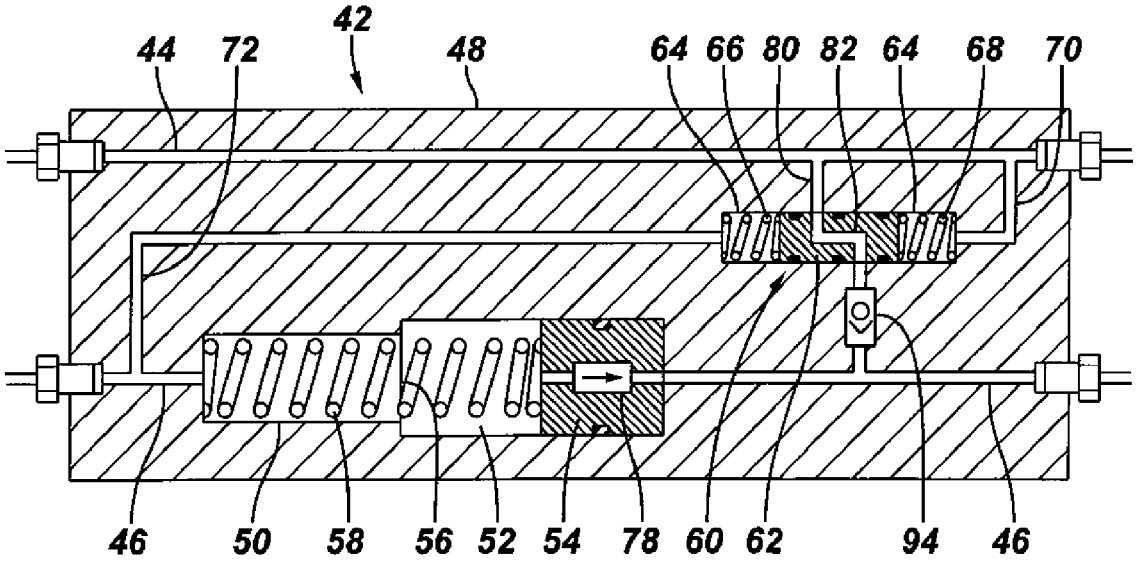
FIG. 6 is a schematic illustration of another example of a hydraulic fluid metering control module that can be used in the system illustrated in FIG. 3, according to an alternate embodiment of the present invention.

Referring generally to FIG. 6, another embodiment of control module 42 is illustrated for use with an actuator 36 working in cooperation with retention mechanism 84. In this embodiment, the arrangement of components in control module 42 is again similar to that described with reference to FIG. 4. However, a check valve 94 is added in crossover branch 80 between the lateral passage 82, extending through piston 62 of piloted valve 60, and the portion of control line 46 extending to piston chamber 52 on a side of metering piston 54 opposite spring 58. Check valve 94 is similarly used to prevent hydraulic pressure from being transmitted through crossover 80 to control line 46 when pressure is applied to control line 44. As described above, if hydraulic pressure is transmitted through crossover 80 before the piloted valve 60 closes, the metering piston 54 can be displaced prematurely.

Figure 7:
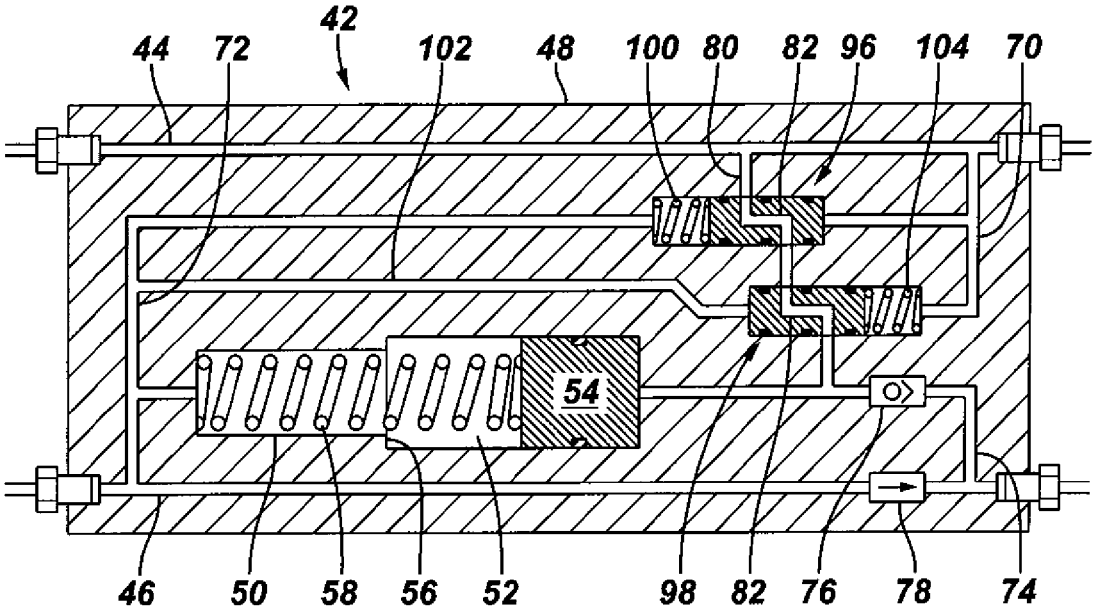
FIG. 7 is a schematic illustration of another example of a hydraulic fluid metering control module that can be used in the system illustrated in FIG. 1, according to an alternate embodiment of the present invention.

Referring generally to FIG. 7, another embodiment of control module 42 is illustrated. In this embodiment, the components of control module 42 are similar to those of the embodiment illustrated in FIG. 2. However, instead of using the single, dual piloted, normally open valve, a pair of piloted valves 96, 98 are employed for use in cooperation with metering piston 54. In this example, each of the piloted valves 96, 98 is a single piloted, normally open valve.

In operation, hydraulic pressure is applied in control line 44 until the pressure is sufficient to close piloted valve 96 and block flow through crossover branch 80. As the hydraulic pressure in control line 44 is further increased, the seal friction force of actuator 36 is overcome and the actuator 36 is displaced to the left, as in the embodiments described above. Hydraulic fluid in piston cavity 40 on the left/opposite side of piston 38 is forced into second control line 46 and into control module 42 where it passes through check valve 76 and into piston chamber 52. As fluid flows into piston chamber 52, metering piston 54 is moved a specific distance until reaching hard stop 56. Again, the volume of hydraulic fluid that displaces metering piston 54 controls the distance over which actuator 36 is incremented.

When hydraulic pressure on control line 44 is bled, the metering piston 54 remains displaced to the left against stop 56 until piloted valve 96 is once again biased to the normally open position by a spring 100. At this stage, spring 58 moves metering piston 54 back to its original position and exhausts the hydraulic fluid accumulated in piston chamber 52 through crossover branch 80 and back into control line 44. Subsequent pressure increases and decreases on control line 44 can be used to further increment actuator 36 until it transitions the well component 28 to a desired configuration.

The actuator 36 can be moved in an opposite direction to a fully closed position, for example, by applying sufficient hydraulic pressure through second control line 46. The application of hydraulic pressure in control line 46 causes the second piloted valve 98 to close via pressure applied through a branch passage 102. While the piloted valve 98 is closed, hydraulic pressure/fluid cannot be communicated from control line 46 to control line 44 or to the opening side of actuator 36. As the actuator 36 is displaced to the right, hydraulic fluid is discharged from piston cavity 40 into control line 44. When the pressure in control line 46 is lowered, piloted valve 98 is biased back to an open position by a spring 104. The pair of single, piloted valves 96, 98 can be used to replace the individual, dual piloted, normally open valves in a variety of embodiments, such as those described above in FIGS. 4-6.

In the embodiments described with reference to FIGS. 1-7, the position of the actuator 36 is incremented as it moves in one direction. For example, the actuator and a corresponding valve element 34 can be moved by predetermined increments in an opening direction. However, the fluid metering control system 41 also can be designed to enable precisely controlled incremental movement of the actuator in both directions, e.g. an opening direction and a closing direction. One example of a fluid metering control system 41 that provides controlled incremental motion in both directions is illustrated in FIGS. 8-10.

Figure 8:
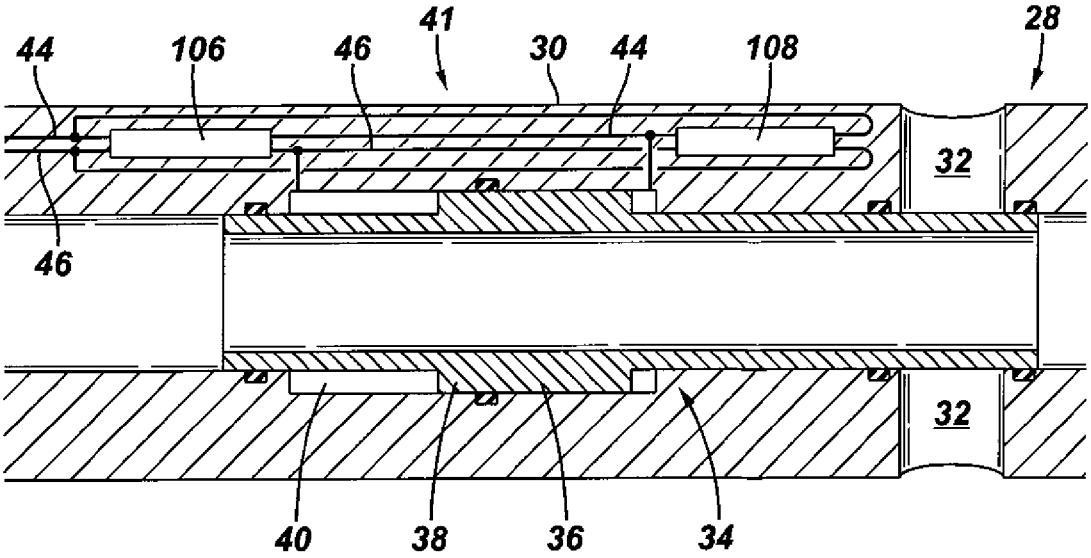
FIG. 8 is a schematic illustration of another example of a shiftable downhole component and a fluid metering control system deployed in a wellbore, according to an alternate embodiment of the present invention.

Referring to FIG. 8, the fluid metering control system 41 comprises a pair of control modules 42 in the form of an open module 106 and a close module 108. In this embodiment, each of the control modules 106, 108 functions similarly to the control module 42 described above with reference to FIGS. 1 and 2. However, control module 106 is designed to control the incremental movement of actuator 36 in a first, e.g. opening, direction; and control module 108 is designed to control the incremental movement of actuator 36 in a second, e.g. closing, direction.

Figure 9:
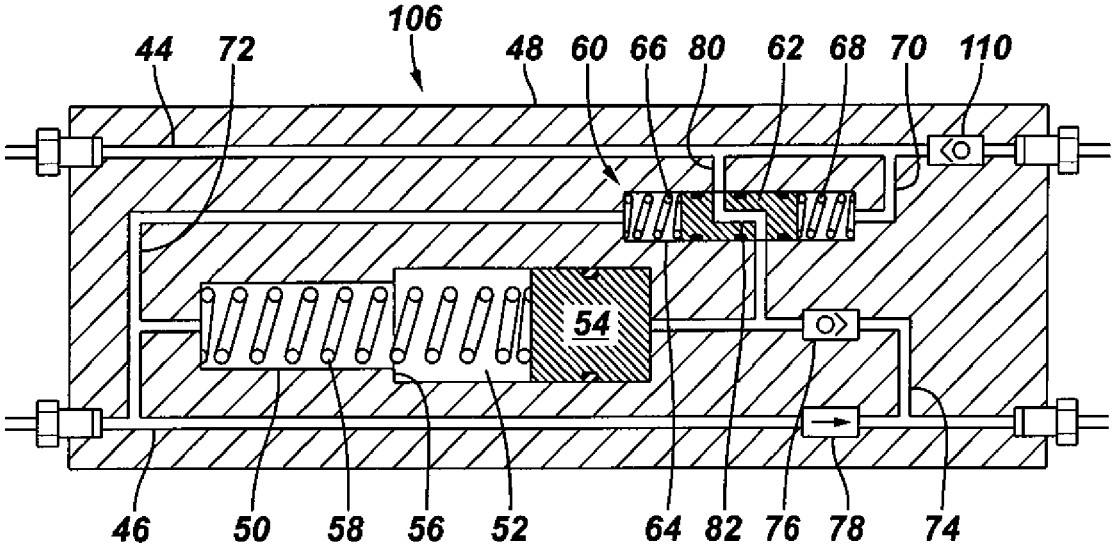
FIG. 9 is a schematic illustration of one example of a first hydraulic fluid metering control module that can be used in the system illustrated in FIG. 8, according to an embodiment of the present invention.
Figure 10:
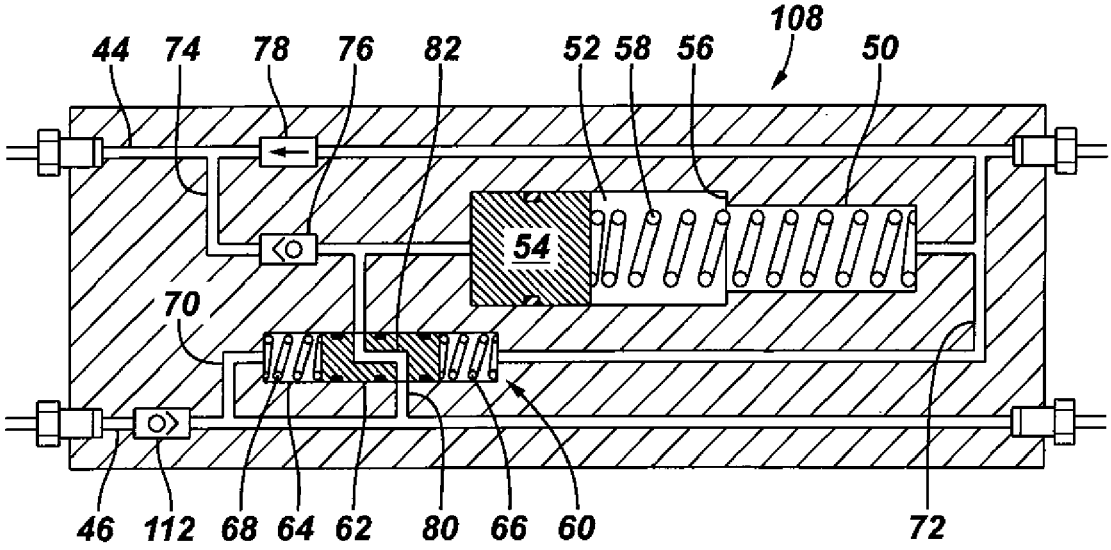
FIG. 10 is a schematic illustration of one example of a second hydraulic fluid metering control module that can be used in the system illustrated in FIG. 8, according to an alternate embodiment of the present invention.

As illustrated in FIG. 9, a second check valve 110 is deployed in the first control line 44 between modules 106 and 108 to block unwanted flow of pressurized fluid from control module 108 into control module 106. Because both control modules 106, 108 are connected to both sides of actuator 36, check valve 110 ensures the hydraulic fluid gets routed to the appropriate control module metering piston 54 when hydraulic pressure is applied either on control line 44 to move the actuator 36 in one direction or on control line 46 to move the actuator 36 in an opposite direction. A similar check valve 112 is deployed in the second control line 46 between modules 106 and 108 to block unwanted flow of pressurized fluid from control module 106 into control module 108, as illustrated in FIG. 10. As further illustrated in FIG. 10, the piloted valve 60 and metering piston 54 of control module 108 are operatively engaged with control line 44 and control line 46 in a generally reversed direction compared to control module 106. This reverse configuration simply allows incremental movement of actuator 36 in the opposite, e.g. closing, direction when pressure signals are applied, released and repeated in control line 46.

One embodiment of a fluid metering control system 41 has been described for controlling incremental movement of the actuator 36 in first and second directions. However, a variety of other fluid metering control systems also can be used to precisely control incremental movement in more than one direction. For example, pairs of the fluid metering control modules 42 described above with reference to FIGS. 4, 5 and 6 can be used in cooperation with retention mechanism 84 in controlling incremental motion of an actuator in a plurality of directions.

The fluid metering control system can be used in cooperation with a variety of downhole well components that benefit from incremental actuation. For example, many types of flow control devices and other shiftable devices can be incorporated into well completions and other downhole equipment in a manner that allows precisely controlled incremental actuation through the use of one or more hydraulic fluid metering control modules. The control modules also can be constructed with a variety of components and in a variety of positions relative to the controlled well component. For example, the control modules can be located within the shiftable component or adjacent the shiftable component. Additionally, the control modules can be used in cooperation with several types of actuators depending on the particular well tool and well application.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

The invention claimed is:

1. A system for use in a well, comprising:

a flow control valve having an actuator positioned to control flow;

a fluid metering control module coupled to the actuator;

a first hydraulic control line coupled to the fluid metering control module; and a second hydraulic control line coupled to the fluid metering control module, wherein the fluid metering control module comprises a metering piston disposed in a piston chamber and a piloted valve that respond to hydraulic inputs through at least one of the first and the second hydraulic control lines to close the piloted valve and thus enable shifting of the actuator by increments, each increment being limited by displacement of the metering piston against a stop, and wherein the first hydraulic control line and the piston chamber are connected via a crossover line extending through the piloted valve, wherein an appropriate pressure signal applied to the first or second hydraulic control lines causes the piloted valve to block flow along the crossover line.

2. The system as recited in claim 1, wherein the piloted valve is a dual piloted, normally open valve.

3. The system as recited in claim 1, wherein the piloted valve comprises a pair of single piloted, normally open valves.

4. The system as recited in claim 1, wherein the piloted valve comprises a piston and the first hydraulic control line is operatively coupled to the piloted valve on one side of the piston, the second hydraulic control line being operatively coupled to the piloted valve on an opposite side of the piston.

5. The system as recited in claim 1, wherein the fluid metering control module further comprises a spring positioned to return the metering piston after each increment of the actuator.

6. The system as recited in claim 1, wherein the displacement of the metering piston is caused by fluid flow through the second hydraulic control line and through a one-way check valve.

7. The system as recited in claim 6, further comprising a pressure relief valve disposed in the second hydraulic control line.

8. The system as recited in claim 1, wherein the first hydraulic control line and the second hydraulic control line are connected via a crossover line extending through the piloted valve, wherein an appropriate pressure signal applied to the first or second hydraulic control line causes the piloted valve to block flow along the crossover line.

9. The system as recited in claim 1, wherein the actuator is coupled to a collet arranged to resist movement of the actuator between increments.

10. A method of controlling flow in a well application, comprising:

coupling a fluid metering control module to an actuator that can be moved to control a flow in a wellbore;

positioning the fluid metering control module and the actuator downhole in a wellbore;

supplying hydraulic fluid through a first control line at sufficient pressure to close a piloted valve and to move the actuator;

directing hydraulic fluid displaced by the actuator, during movement of the actuator, through a second control line and into a piston chamber to displace a metering piston;

limiting movement of the metering piston to control the incremental movement of the actuator;

releasing pressure on the first control line to enable movement of the piloted valve to an open position; and biasing the metering piston to discharge hydraulic fluid from the piston chamber and into the first control line, wherein the first control line and the piston chamber are connected via a crossover line extending through the piloted valve, wherein an appropriate pressure signal applied to the first or second hydraulic control lines causes the piloted valve to block flow along the crossover line.

11. The method as recited in claim 10, wherein directing comprises deploying a pressure relief valve in the second control line to ensure the hydraulic fluid is properly routed into the piston chamber.

12. The method as recited in claim 10, further comprising using a check valve to prevent movement of the actuator when hydraulic fluid is discharged from the piston chamber by placing the check valve at a position blocking flow back to the actuator.

13. The method as recited in claim 10, further comprising using a collet coupled to the actuator to prevent movement of the actuator when hydraulic fluid is discharged from the piston chamber.

14. The method as recited in claim 10, wherein supplying comprises closing a dual piloted, normally open valve.

15. The method as recited in claim 10, wherein supplying comprises closing a single piloted, normally open valve.

16. The method as recited in claim 10, further comprising providing a subsequent supply of hydraulic fluid through the first control line to initiate a subsequent incremental movement of the actuator.

17. The method as recited in claim 10, wherein coupling comprises coupling a pair of fluid metering control modules to the actuator to control incremental movement of the actuator in both a closing direction and an opening direction.

* * * * *